US007055818B2

(12) United States Patent
Furusawa

(10) Patent No.: US 7,055,818 B2
(45) Date of Patent: Jun. 6, 2006

(54) SHEET TREATING APPARATUS AND IMAGE FORMING APPARATUS

(75) Inventor: Motohiro Furusawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/368,599

(22) Filed: Feb. 20, 2003

(65) Prior Publication Data

US 2003/0160385 A1 Aug. 28, 2003

(30) Foreign Application Priority Data

Feb. 28, 2002 (JP) ..... 2002-053773

(51) Int. Cl.
*B65H 3/26* (2006.01)

(52) U.S. Cl. ..... 271/220
(58) Field of Classification Search ..... 271/220; B65H 29/54
See application file for complete search history.

(56) References Cited

U.S. PATENT DOCUMENTS 4,883,265 A * 11/1989 Iida et al. ..... 271/220
4,988,087 A * 1/1991 Sardano et al. ..... 271/314
5,033,731 A * 7/1991 Looney ..... 271/176
5,094,660 A * 3/1992 Okuzawa ..... 493/320
5,288,064 A * 2/1994 Manabe et al. ..... 271/3.08
6,065,748 A * 5/2000 Hutson ..... 271/222

FOREIGN PATENT DOCUMENTS

CN 1197758 A 11/1998
GB 2215313 A * 9/1989
JP 2-106551 * 4/1990

* cited by examiner

*Primary Examiner*—Donald P. Walsh
*Assistant Examiner*—Kaitlin Joerger
(74) *Attorney, Agent, or Firm*—Fitzpatrick, Cella, Harper & Scinto

(57) ABSTRACT

A sheet treating apparatus and an image forming apparatus having the same which are excellent in durability and exhibit excellent sheet transportability while allowing saving of space, in which a large number of curled sheets can be stacked in an aligned state. In the sheet treating apparatus, a delivery sheet holding-down member is provided in an upper roller of an FD upper roller.

15 Claims, 6 Drawing Sheets

SHEET TREATING APPARATUS AND IMAGE FORMING APPARATUS

BACKGROUND OF THE INVENTION

1. Field of the Invention

The present invention relates to a sheet treating apparatus for transporting and stacking a sheet, in particular to an image forming apparatus, for example, a copying machine, a printer, or a facsimile apparatus, which is provided with a function for forming an image on a transfer material (recording medium) such as a sheet.

2. Related Background Art

FIG. 7 shows a schematic view of an image forming apparatus A1 in accordance with a conventional technique.

Conventionally, in an image forming apparatus employing the electrophotographic process, in general, a sheet is fed and transported into an apparatus main body, and a toner image is transferred onto the sheet and is fixed thereon by a fixing device T. When the sheet is to be delivered, it is transported by an FD upper roller 15 to be stacked on a delivery tray 19. Sheets 3 to be stacked on the delivery tray 19 are usually stacked from the bottom in the order of delivery so as to be aligned entirely along a tray shape of the delivery tray 19.

On the other hand, if the sheets 3 are delivered in a curled state, the sheets 3 are not aligned entirely along the tray shape but are stacked in a state in which a curled portion thereof partially deviates from the tray shape.

Therefore, a trailing edge of the sheets 3 stacked on the delivery tray 19 in the curled state covers and blocks a sheet delivery outlet of the apparatus main body and collides with a leading edge of a sheet to be subsequently delivered.

As a result, the succeeding sheet is bent at a corner thereof and is further bent in an accordion shape so that it cannot be delivered. This becomes a cause of jam, or of the succeeding sheet pushing out a trailing end of a sheet already stacked and further making the sheet fall off the tray.

Thus, conventionally, there is a structure for securing a sheet delivery outlet by adhering a Mylar (trademark) 10 to a top cover of a delivery portion with a pressure sensitive adhesive double coated tape as shown in FIG. 7 to hold down a trailing edge of sheets stacked on the delivery tray 19.

In this structure, the Mylar 10 with the pressure sensitive adhesive double coated tape adhered to one end thereof is adhered to a lower surface of the top cover situated above the FD upper roller, by pressing thereon a pressure sensitive adhesive double coated tape portion upward from below, whereby the other end of the Mylar 10 is positioned so as to serve as a sheet holding-down portion.

However, with this structure, since a sheet-passing portion of the Mylar 10 is worn and broken over the time of use, a long service-life cannot be expected of the Mylar 10.

In addition, the pressure sensitive adhesive double coated tape has to be used, which may come off depending upon the manner of adhesion, and for example, in the case in which the Mylar 10 itself is used in a bent state, an angle of abutment against a sheet with respect to an angle at which the sheet is delivered is not fixed. This tends to cause corner bending or jam.

Further, since the Mylar 10 is fixed to the lower surface of the top cover, a space for allowing adhesion of the Mylar 10 is required above the FD upper roller so that saving of space is difficult.

SUMMARY OF THE INVENTION

The present invention has been made in order to solve the above-mentioned problems inherent in the conventional art, and an object thereof is to provide a sheet treating apparatus and an image forming apparatus having the same which are excellent in durability and exhibit excellent sheet transportability while allowing saving of space, in which a large number of curled sheets can be stacked in an aligned state.

In order to attain the above-mentioned object, according to the present invention, there is provided a sheet treating apparatus including:

- sheet transport means for transporting a sheet along a sheet transport path;
- a sheet stacking portion onto which the sheet transported by the sheet transport means is stacked; and
- a sheet holding-down member for holding down a trailing edge side in a transport direction of the sheet stacked on the sheet stacking portion, toward the sheet stacking portion,
- wherein the sheet holding-down member is provided in the sheet transport means.

According to the sheet treating apparatus of the invention, it is also preferred that:

- the sheet transport means includes a sheet transport member that abuts against at least a surface on one side of a sheet to transport the sheet;
- the sheet stacking portion stacks the sheet transported by the sheet transport means with a surface on the other side of the sheet facing down; and
- the sheet holding-down member is provided in the sheet transport member.

According to the sheet treating apparatus of the invention, it is also preferred that:

- the sheet transport means includes a pair of sheet transport rotary members which are vertically provided as a pair across the sheet transport path and which nip a sheet with a nip portion to transport the sheet; and
- the sheet holding-down member is provided in a shaft of an upper transport rotary member of the pair of sheet transport rotary member.

According to the sheet treating apparatus of the invention, it is also preferred that the sheet holding-down member includes: a guide portion for guiding a sheet from a downstream side of the shaft of the upper transport rotary member to the sheet stacking portion; and a sheet holding-down portion for holding down sheets stacked on the sheet stacking portion.

According to the sheet treating apparatus of the invention, it is also preferred that the guide portion is formed in an upwardly projecting shape between a portion equivalent to the nip portion and the sheet holding-down portion.

According to the sheet treating apparatus of the invention, it is also preferred that:

- the sheet holding-down member is attached to the shaft of the upper transport rotary member so as to be pivotable and pivots according to a height of sheets stacked on the sheet stacking portion; and
- the guide portion is provided with a projecting shape portion, which forms an upwardly projecting shape projecting above a track of a direction of a sheet transport by the nip portion in the case in which the sheet holding-down portion is located at least in a predetermined position below the track of the direction of sheet transport by the nip portion, in the vicinity on the downstream side of the portion equivalent to the nip portion.

According to the present invention, it is also preferred that:

the sheet treating apparatus of the invention includes rotation stopping means for stopping rotation of the sheet holding-down member in a direction in which the height of sheets stacked on the sheet stacking portion increases; and the predetermined position is a position where a rotation movement of the sheet holding-down member is stopped by the rotation stopping means.

According to the present invention, there is provided an image forming apparatus including:

image forming means that forms an image on a sheet; and a sheet treating apparatus as described above, in which the sheet on which an image is formed by the image forming means is stacked on the sheet treating apparatus.

DESCRIPTION OF THE PREFERRED EMBODIMENTS

A preferred embodiment of the present invention will be hereinafter described in detail illustratively with reference to the accompanying drawings. Note that dimensions, materials, shapes and relative arrangements of components described in this embodiment should be changed as appropriate according to the structure of an apparatus to which the present invention is applied and various conditions, and are not intended to limit the scope of the present invention only to those described in the embodiment below.

Figure 1:
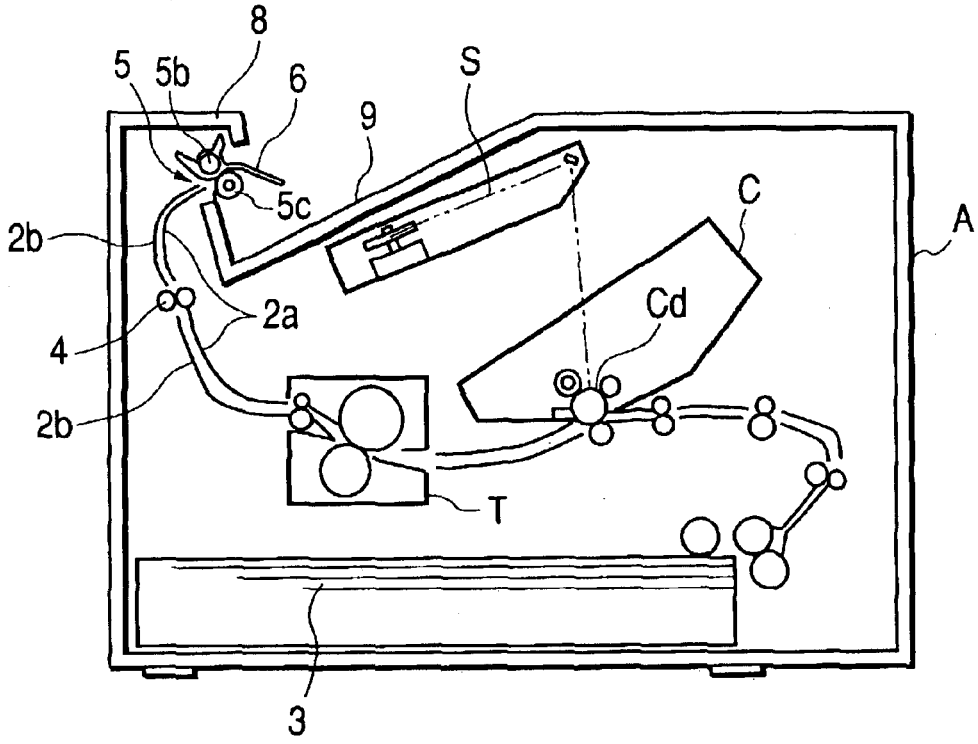
FIG. 1 is a schematic sectional view of an image forming apparatus in accordance with an embodiment of the present invention.

FIG. 1 is a schematic sectional view showing an image forming apparatus in which the electrophotographic process is adopted, as an image forming apparatus in accordance with this embodiment.

As shown in FIG. 1, the image forming apparatus in accordance with this embodiment is provided with a scanner S, a process cartridge C, a fixing device T, and the like in an apparatus main body A thereof. Note that an electrophotographic photosensitive drum Cd serving as an image bearing member is incorporated in the process cartridge C.

Further, with such a structure, a sheet 3 fed from a cassette is transported to a photosensitive drum Cd portion of the process cartridge C and an image is transferred onto the sheet 3. Moreover, after the image is transferred, the sheet 3 is transported to the fixing device T arranged on a downstream side of the process cartridge C, and the image is fixed thereon by the fixing device T.

A transport guide member 2 for guiding the sheet 3 from the fixing device T to an FD upper roller 5 through an FD lower roller 4 is provided above the fixing device T. This transport guide member 2 is constituted by an inner transport guide 2*a* and an outer transport guide 2*b*. Consequently, the sheet 3 is delivered onto a delivery tray 9 serving as a sheet stacking portion and stacked thereon one after another.

Here, with respect to the FD upper roller 5, the case is shown in which a sheet with an image formed thereon is delivered with an image forming surface as a surface on another side facing down (face down delivery). However, the FD upper roller 5 may be used to deliver the sheet with the image forming surface facing up (face up delivery).

Further, the FD upper roller 5 includes an upper roller 5*b* and a lower roller 5*c* formed as a pair. The FD upper roller 5 constitutes sheet transport means or a pair of sheet transport rotary members. In particular, the upper roller 5*b* constitutes a sheet transport member or an upper transport rotary member and abuts against a surface on one side of a sheet (non-image forming surface) to transport the sheet.

Figure 2:
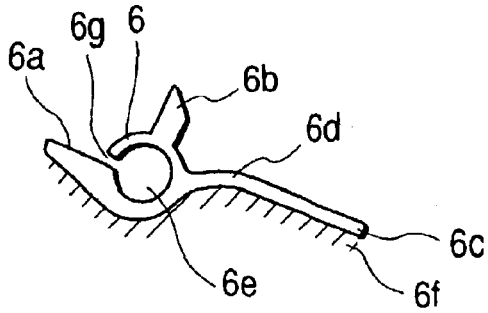
FIG. 2 is a schematic side view of a delivery sheet holding-down member of the image forming apparatus in accordance with the embodiment of the present invention.
Figure 3:
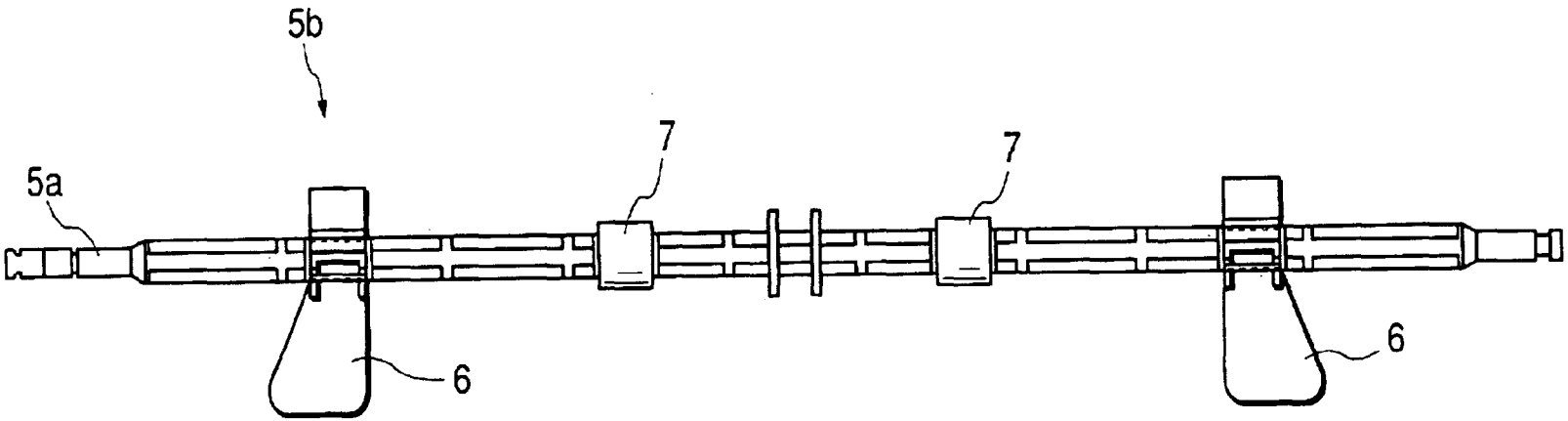
FIG. 3 is a schematic front view of a unit including the delivery sheet holding-down member of the image forming apparatus in accordance with the embodiment of the present invention.

FIG. 2 is a schematic side view of a delivery sheet holding-down member 6 serving as a sheet holding-down member which is a characteristic structure of this embodiment. FIG. 3 is a schematic view showing a roller unit constituting the upper roller 5*b*.

As shown in FIG. 2, the delivery sheet holding-down member 6 is provided with a stopper 6*a*, a stopper 6*b*, a holding-down portion 6*c* serving as a sheet holding-down portion, a bosom portion 6*d* as a projecting shape portion, and a bearing portion 6*e*. POM (polyacetal, polyoxymethylene) of a sliding grade is used as a material of the delivery sheet holding-down member 6. A hatching portion denoted by symbol 6*f* in FIG. 2 constitutes a guide portion which is provided on a sheet transport path side and guides a sheet. A slit 6*g* is formed in the bearing portion 6*e*. The delivery sheet holding-down member 6 can be fitted onto an FD upper roller shaft 5*a* of the upper roller 5*b* of the FD upper roller 5 by elastically deforming the bearing portion 6*e* to spread out the slit 6*g*.

Further, the delivery sheet holding-down member 6 is attached to the FD upper roller shaft 5*a* of the upper roller 5*b* of the FD upper roller 5 so as to pivot (swing) freely as shown in FIG. 3 and is constituted as a sub-component of an FD upper roller unit. The delivery sheet holding-down member 6 holds down the sheet 3, which is delivered onto the delivery tray 9 and stacked thereon, with the holding-down portion 6*c*. In the upper roller 5*b*, two FD roller rubbers 7 are attached in a central part of the FD upper roller shaft 5*a* and two delivery sheet holding-down members 6 are attached on outer sides thereof (the delivery sheet holding-down members 6 are symmetrically provided).

Figure 4:
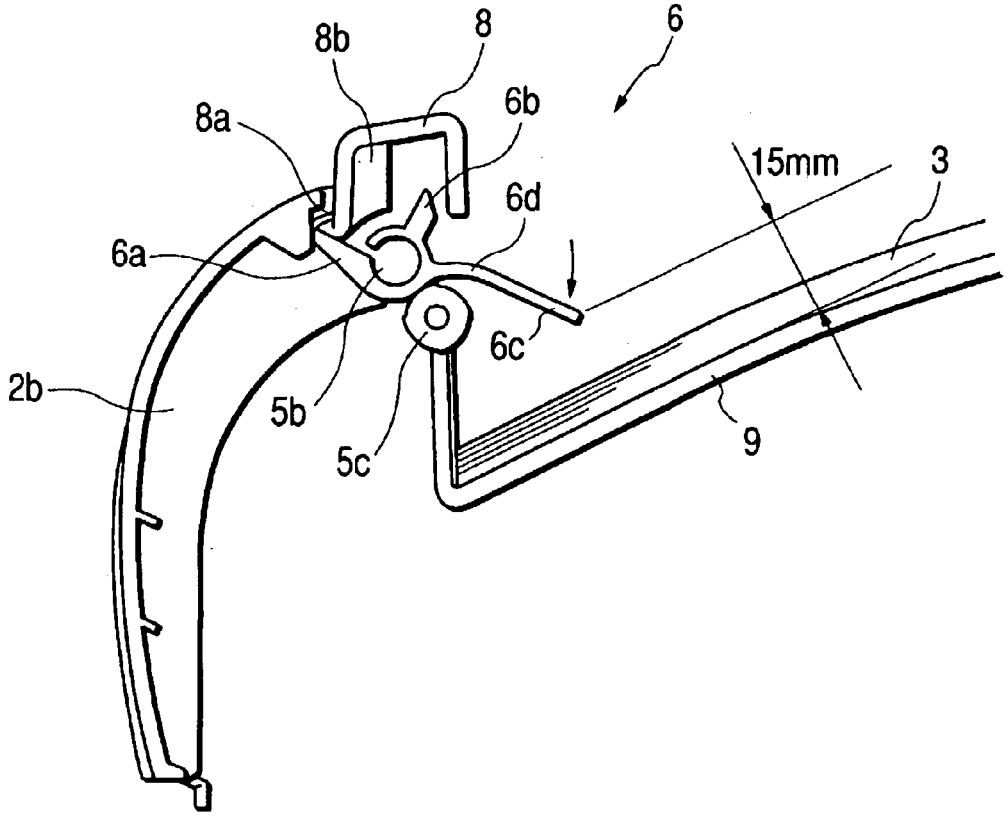
FIG. 4 is a schematic sectional view of a main part of the image forming apparatus in accordance with the embodiment of the present invention.

Operations of the image forming apparatus at a non-sheet passing time will be hereinafter described. FIG. 4 is a schematic view showing a sheet transport portion and a sheet stacking portion at the non-sheet passing time.

At the non-sheet passing time, the delivery sheet holding-down member 6 pivots in a direction indicated by the arrow with the aid of its own gravity about the FD upper roller shaft 5*a* as a pivotal center as shown in FIG. 4. The stopper portion 6*a* of the delivery sheet holding-down member 6 abuts against a stopper receiving portion 8*a* of a top cover 8, thereby positioning the delivery sheet holding-down member 6.

In this embodiment, the holding-down portion 6*c* is set so as to be located at a height of approximately 15 mm from a tray surface of the delivery tray 9, in its lower limit position where the stopper portion 6*a* of the delivery sheet holding-down member 6 abuts against the stopper receiving portion 8*a* of the top cover 8.

Consequently, even in the case when the sheet 3 is already stacked on the delivery tray 9 and a user has removed the sheet 3 from the delivery tray 9, the user can place the removed sheet 3 on the delivery tray 9 again. In this way, consideration is given so that the holding-down portion 6*c* does not become obstructive on the delivery tray 9.

In addition, when the stacking height of the sheets 3 stacked on the delivery tray 9 is lower in position than the position of the holding-down portion 6*c* of the delivery sheet holding-down member 6 (at a height of approximately 15 mm from the tray surface of the delivery tray 9) as in FIG. 4, the delivered and stacked sheets 3 are not blocking the delivery outlet and the holding-down portion 6*c* of the delivery sheet holding-down member 6 is not in contact with a trailing edge portion of the stacked sheets.

Figure 5:
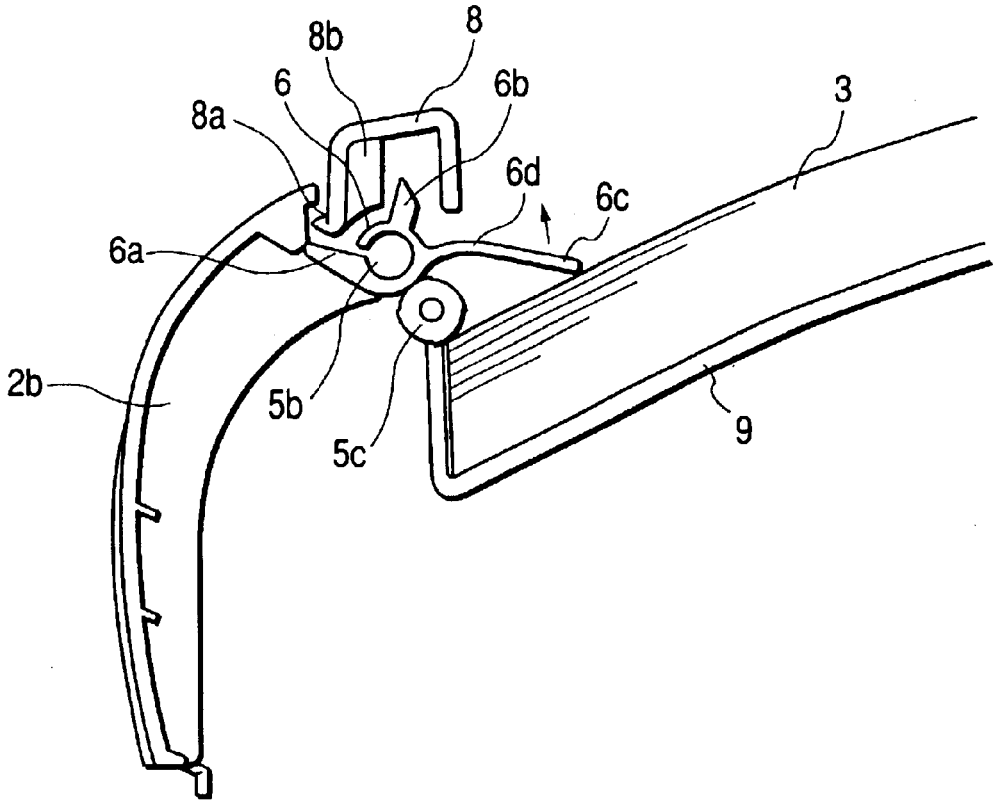
FIG. 5 is a schematic sectional view of the main part of the image forming apparatus in accordance with the embodiment of the present invention.
Figure 6:
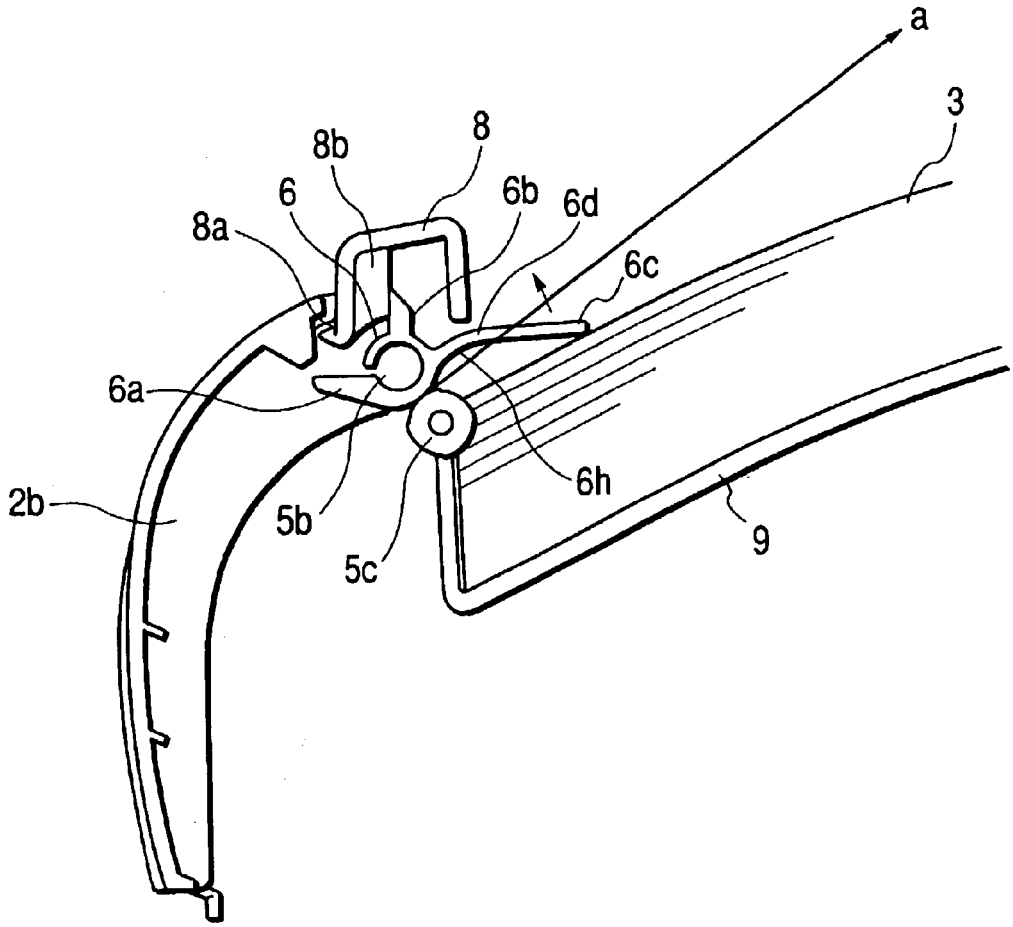
FIG. 6 is a schematic sectional view of the main part of the image forming apparatus in accordance with the embodiment of the present invention.
Figure 7:
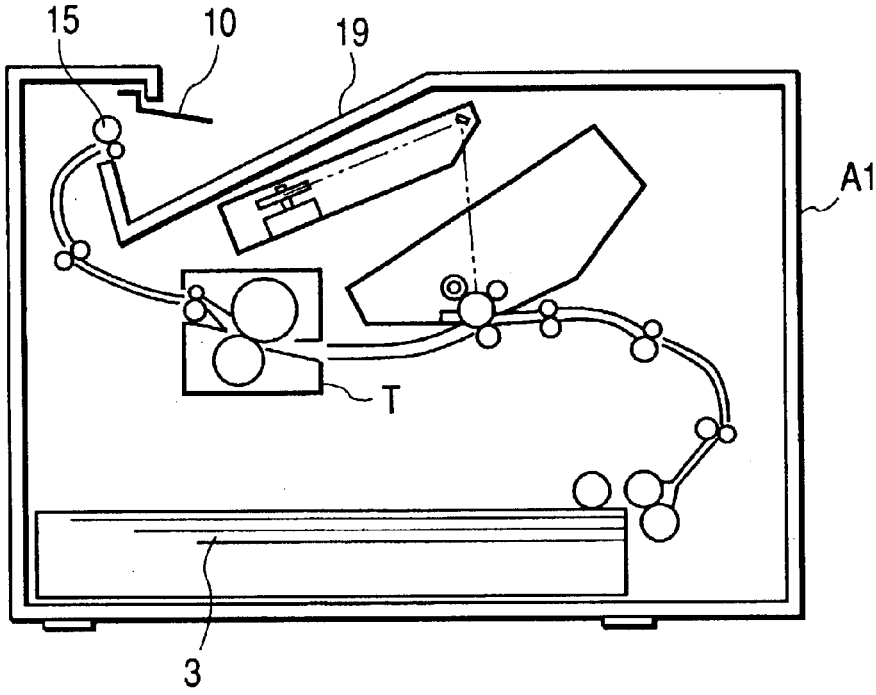
FIG. 7 is a schematic sectional view of an image forming apparatus in accordance with a conventional technique.

Next, operations of the image forming apparatus at a sheet passing time will be described. FIG. 5 is a schematic view showing the sheet transport portion and the sheet stacking portion at the sheet passing time, and FIG. 6 is a schematic sectional view showing a substantially fully loaded state of the delivery tray.

At the sheet passing time, when the sheet 3 passes the delivery sheet holding-down member 6, the delivery sheet holding-down member 6 is pushed in a delivery direction to be caused to pivot in a direction indicated by the arrow about the FD upper roller shaft 5*a* as a pivotal center as shown in FIG. 5, whereby the stopper portion 6*a* of the delivery sheet holding-down member 6 is separated apart from the stopper receiving portion 8*a* of the top cover 8.

At this point, the delivery sheet holding-down member 6 pushes down the non-printing surface side of the sheets 3 in the position of the holding-down portion 6*c* with the aid of its own gravity. Then, when the trailing edge of the sheet 3 passes a nip portion of the FD upper roller 5, the delivery sheet holding-down member 6 pivots in a direction opposite to the direction indicated by the arrow into a non-sheet passing position. Consequently, even in the case of a sheet having a characteristic of floating upward due to static electricity to get into a gap between the top cover 8 and the FD upper roller shaft 5*a*, the delivery sheet holding-down member 6 can surely knock the sheet down and cause it to fall onto the delivery tray 9.

In addition, in this case, as shown in FIG. 5, the height of the sheets 3 stacked on the delivery tray 9 is higher in position than the lower limit position of the holding-down portion 6*c* of the delivery sheet holding-down member 6 (at a height of approximately 15 mm from the tray surface of the delivery tray 9), and the stopper portion 6*b* of the delivery sheet holding-down member 6 is in a state in which it is out of contact with the stopper receiving portion 8*b* of the top cover 8 serving as rotation stopping means.

In this state, the delivered and stacked sheets 3 are not blocking the delivery outlet. However, the height of the sheet stack of the sheets 3 is closer in position to the delivery outlet than that of the case shown in FIG. 4 when the height of the sheet stack of the sheets 3 is lower in position than the position of the holding-down portion 6*c*, so that the delivery sheet holding-down member 6 is pushing down, with the aid of its own gravity, a top surface of the sheets 3 stacked on the delivery tray 9 on the trailing edge side.

Then, when the sheets 3 are successively delivered and stacked one after another and the sheets 3 are nearly fully loaded on the delivery tray 9, as shown in FIG. 6, the holding-down portion 6*c* of the delivery sheet holding-down member 6 is pushed upward by the top surface of the sheets 3 stacked on the delivery tray 9.

Thus, the delivery sheet holding-down member 6 pivots in a direction indicated by the arrow shown in FIG. 6 about the FD upper roller shaft 5*a*. The stopper portion 6*b* of the delivery sheet holding-down member 6 eventually abuts against the stopper receiving portion 8*b* of the top cover 8 and, thereafter, the delivery sheet holding-down member 6 is positioned in this state regardless of whether the apparatus is at the sheet passing time or non-sheet passing time.

At this point, the holding-down portion 6*c* of the delivery sheet holding-down member 6 is located below the track of a delivery direction "a" in which a sheet is delivered by the FD upper roller 5 (a nip line direction, or a direction of sheet transport by the nip portion), and a recessed surface 6*h* of a lower side of the bosom portion 6*d* is located above the track of the delivery direction "a".

Here, it is preferable that the holding-down portion 6*c* of the delivery sheet member 6 is located below the track of the delivery direction "a" and the bosom portion 6*d* is located above the track of the delivery direction "a". However, it is sufficient if the holding-down portion 6*c* is located below the recessed surface 6*h* on the lower side of the bosom portion 6*d*.

In addition, in the delivery sheet holding-down member 6 shown in FIG. 2, in the guide portion 6*f*, the bosom portion 6*d* having an upwardly projecting shape is formed in the vicinity on the downstream side of the bearing portion 6*e* which is a portion equivalent to the nip portion, and the downstream side of the bosom portion 6*d* is formed substantially straight up to the holding-down portion 6*c*. However, it is sufficient if the guide portion 6*f* is formed in an upwardly projecting shape between the bearing portion 6*e* and the holding-down portion 6*c*.

When the holding-down portion 6*c* of the delivery holding-down member 6 is pushed up by the sheets 3 stacked on the delivery tray 9 and the stopper portion 6*b* of the delivery holding-down member 6 is in contact with the stopper receiving portion 8*b* of the top cover 8, the delivery sheet holding-down member 6 presses the top surface of the sheets 3 stacked on the delivery tray 9 with the aid of its own gravity and an biasing force of a stopper mechanism. Thus, the trailing edge of the sheets 3 on the delivery tray 9 cannot rise above the holding-down portion 6*c* of the delivery sheet holding-down member 6.

At this point, as shown in FIG. 6, the height of the delivered and stacked sheets 3 is closer in position to the delivery outlet than that shown in FIG. 5. However, since the bosom portion 6*d* is located higher in position than the holding-down portion 6*c* of the delivery sheet holding-down member 6, even in the case in which the sheet 3 is stacked in a curled state, the trailing edge of the sheet 3 never floats upward above the holding-down portion 6*c* of the delivery sheet holding-down member 6 and further, the delivery outlet can be secured surely by the bosom portion 6*d*. Thus, the delivery outlet is never blocked by the trailing edge of the sheets 3 which are already stacked in the curled state, so that a large number of sheets 3 to be delivered one after another are delivered and stacked with good alignment property regardless of an amount of curling of the already stacked sheets. Even if the trailing edge of the sheet 3 stacked in the curled state floats up higher in position than the holding-down portion 6*c* of the delivery sheet holding-down member 6, the delivery outlet can be secured surely by forming the bosom portion 6*d* in an upwardly projecting shape, in particular by forming it in a projecting shape such that the recessed surface 6*h* on the lower side is located above the track of the delivery direction "a" of a sheet.

According to this embodiment, the delivery sheet holding-down member 6 for holding down the trailing edge of the sheet 3 delivered on the delivery tray 9 after an image is printed thereon is incorporated in the delivery roller unit so as to be freely pivotable, whereby it becomes unnecessary to provide in the apparatus main body a portion for attaching the delivery sheet holding-down member. Thus, it becomes possible to achieve saving of space and make the apparatus main body compact. Moreover, since the delivery sheet holding-down member is prevented from coming off by attaching the delivery sheet holding-down member to the shaft of the delivery roller, improved durability can be realized. In addition, good sheet transportability can be maintained so that a large number of curled sheets can be delivered and stacked in an aligned state, whereby improved sheet stackability can be realized.

Note that, in this embodiment, the delivery sheet holding-down member 6 presses the sheets stacked on the delivery tray 9 with the aid of its own gravity. However, it is also possible to provide biasing means for biasing the holding-down portion 6*c* of the delivery sheet holding-down member 6 in a direction of the delivery tray 9.

In addition, although two delivery sheet holding-down members 6 are provided in this embodiment, the number thereof is not limited and only one delivery sheet holding-down member may be provided. However, it is effective to provide a plurality of the delivery sheet holding-down members, and it is preferable to provide them substantially symmetrically with respect to a cross direction of a sheet to be transported in the sheet transport direction.

Further, in the FD upper roller 5, although the upper roller 5*b* and the lower roller 5*c* are arranged vertically in this embodiment, they may be arranged substantially horizontally. The sheet holding-down member may be attached to a transport member in the case in which a transport member abuts against a surface on one side of a sheet to transport the sheet and the sheet is stacked on a delivery tray with a surface on the other side of the sheet facing the delivery tray.

As has been described above, the present invention can provide an apparatus which is excellent in durability and exhibits excellent sheet transportability while allowing saving of space, in which a large number of curled sheets can be stacked in an aligned state.

What is claimed is:

1. A sheet treating apparatus comprising:

a sheet transport rotary member, which transports a sheet along a sheet transport path;

a sheet stacking portion onto which the sheet transported by the sheet transport rotary member is stacked;

a sheet holding-down member for holding down a trailing edge side in a transport direction of the sheet stacked on the sheet stacking portion, toward the sheet stacking portion, wherein the sheet holding-down member rotates according to a height of sheets stacked on the sheet stacking portion;

a stopper portion provided on the sheet holding-down member; and a stopper receiving member for abutting against the stopper portion and for regulating rotation of the holding-down member in a direction in which the height of the sheets stacked on the sheet stacking portion increases.

2. A sheet treating apparatus according to claim 1, wherein:

the sheet transport rotary member transports the sheet while abutting against at least one side surface of the sheet;

the sheet transported by the sheet transport rotary member is stacked onto the sheet stacking portion with the other side surface of the sheet facing down.

3. A sheet transporting apparatus according to claim 1, wherein:

the sheet transport rotary member is one of a pair of sheet transport rotary members which are vertically provided as a pair across the sheet transport path and which nip a sheet with a nip portion of the pair of the sheet transport rotary members to transport the sheet; and the sheet holding-down member is provided on a shaft of an upper transport rotary member of the pair of sheet transport rotary members.

4. A sheet treating apparatus according to claim 3, wherein the sheet holding-down member comprises:

a guide portion for guiding a sheet from a downstream side of the shaft of the upper transport rotary member to the sheet stacking portion; and a sheet holding-down portion for holding down the sheet stacked on the sheet stacking portion.

5. A sheet treating apparatus according to claim 4, wherein the guide portion is formed in an upwardly projecting shape between a portion equivalent to the nip portion and the sheet holding-down portion.

6. A sheet treating apparatus according to claim 4 wherein:

the guide portion is provided with a recessed portion in the vicinity of and downstream side of the portion equivalent to the nip portion, the recessed portion being concaved upwardly above a track of the sheet transported by the nip portion when the sheet holding-down portion is located at least in a predetermined position below the track.

7. A sheet treating apparatus according to claim 6, wherein:

the predetermined position is a position where a rotation movement of the sheet holding-down member is stopped by the stopper receiving member.

8. An image forming apparatus comprising:

image forming means for forming an image on a sheet; and a sheet treating apparatus as set forth in claim 1, wherein the sheet on which the image is formed by the image forming means is stacked on the sheet treating apparatus.

9. A sheet treating apparatus comprising:

a tray on which a sheet is stacked;

a pair of rollers for transporting the sheet such that the sheet falls onto the tray; and a holding-down member which is pivotably supported and holds down the sheet stacked on the tray toward the tray, wherein the holding-down member includes a stopper portion for abutting against a stopper receiving portion provided on an apparatus main body side to regulate rotation of the holding-down member in a direction in which the height of the sheets stacked on the sheet stacking portion increases.

10. A sheet treating apparatus according to claim 9, wherein the holding-down member has a bearing portion, into which a roller shaft of the pair of rollers is fitted, to embrace the roller shaft.

11. A sheet treating apparatus according to claim 10, wherein the holding-down member has a slit extending through the bearing portion from an inner side to an outer side of the bearing portion, and the slit is formed such that the roller shaft can be fit into the bearing portion through the slit which is spread out by deforming the holding-down member.

12. A sheet treating apparatus according to claim 9, further comprising:

a second stopper receiving portion for abutting against a second stopper portion provided on the holding-down member and for regulating rotation of the holding-down member such that the holding-down surface does not pivot toward the tray over a predetermined position that is at a predetermined distance apart from the tray.

13. A sheet treating apparatus according to claim 12, wherein the holding-down member has a recessed surface of an upwardly recessed shape, between the pair of rollers and the guide surface and on the tray side, and the recessed surface is located above a track of a leading edge of a sheet transported by the pair of rollers when the holding-down member is located in the predetermined position.

14. A sheet treating apparatus according to claim 4, wherein the guide portion is provided with a recess surface, which has an upwardly concaved shape, the recess surface being located above a tract of a leading edge of a sheet transported by the sheet transport means, and the sheet holding-down portion is located below the track of the leading edge of the sheet transported by the sheet transport rotary member.

15. A sheet treating apparatus according to claim 1, wherein the sheet holding-down member is provided on a shaft of the sheet transport rotary member.

* * * * *

UNITED STATES PATENT AND TRADEMARK OFFICE

CERTIFICATE OF CORRECTION

PATENT NO. : 7,055,818 B2
APPLICATION NO. : 10/368599
DATED : June 6, 2006
INVENTOR(S) : Motohiro Furusawa It is certified that error appears in the above-identified patent and that said Letters Patent is hereby corrected as shown below:

COVER PAGE AT ITEM (56) RC:
Insert: --Other Documents, Office Action dated April 29, 2005, issued by the Patent office of The People's Republic of China, in application no. 03106397.7.--

COLUMN 2:
Line 12, "sheet" (first occurrence) should read --a sheet--.
Line 40, "member." should read --members--.

COLUMN 3:
Line 13, "image" (first occurrence) should read --an image--.

COLUMN 8:
Line 8, "sheet;" should read --sheet; and--.
Line 12, "transporting" should read --treating--.
Line 34, "claim 4" should read --claim 4,--.
Line 49, "image" should read --an image--.

Signed and Sealed this

Thirteenth Day of March, 2007

JON W. DUDAS
*Director of the United States Patent and Trademark Office*